US005110303A

United States Patent [19]

Hardy

[11] Patent Number: 5,110,303

[45] Date of Patent: May 5, 1992

[54] ELECTRICAL CORD CONNECTION RETAINER

[76] Inventor: James L. Hardy, 962 Lands End Rd., Farmington, Utah 84025

[21] Appl. No.: 737,770

[22] Filed: Jul. 30, 1991

[51] Int. Cl.[5] ..... H01R 13/62

[52] U.S. Cl. ..... 439/367; 439/373; 439/501; 174/138 F; 24/307; 24/573.1

[58] Field of Search ..... 174/93, 138 F, DIG. 11; 439/367, 369, 371, 373, 135, 501; 24/163 R, 307, 573.1, 305, 633

[56] References Cited

U.S. PATENT DOCUMENTS

| | | | |
|---|---|---|---|
| 2,708,123 | 5/1955 | Risley et al. | 174/DIG. 11 |
| 3,014,194 | 12/1961 | Berglund | 439/369 |
| 3,030,601 | 4/1962 | Krebs | 174/93 |
| 3,059,209 | 10/1962 | Bird | 439/369 |
| 3,187,090 | 6/1965 | Edwards | 174/138 F |
| 3,344,393 | 9/1967 | Hendee | 439/369 |
| 3,495,026 | 2/1970 | Gillemot | 174/138 F |
| 4,143,934 | 3/1979 | Seibert | 439/369 |
| 4,643,505 | 2/1987 | House et al. | 439/369 |
| 4,869,683 | 9/1989 | Nelson | 439/367 X |
| 4,891,256 | 1/1990 | Kite, III et al. | 174/DIG. 11 |

*Primary Examiner*—Neil Abrams
*Assistant Examiner*—Khiem Nguyen
*Attorney, Agent, or Firm*—Trask, Britt & Rossa

[57] ABSTRACT

An electrical cord retainer apparatus adapted for securing the interconnection of two or more electrical cords is disclosed. The retainer includes a flexible housing fitted with a longitudinally non-stretchable retainer strip. The housing is adapted to be encased about a connection of electrical power cords and to provide a high coefficient of friction fit between the interior of the housing and the elecrical cord plugs sufficient to retain those plugs in intercooperation notwithstanding the application of forces to the cords at a distant location. The housing is fitted with a connection structure such as a zipper which is adapted to close the housing about the structure of electrical cord for purposes of creating this friction union.

19 Claims, 11 Drawing Sheets

ELECTRICAL CORD CONNECTION RETAINER

BACKGROUND OF THE INVENTION

1. Field

This invention relates to apparatus designed for insuring the integrity of an electrical connection between two electrical cords. More specifically, the invention is directed to an apparatus adapted for retaining electrical cords in an intercooperated engagement while protecting that engagement from environmental hazards.

2. State of the Art

Electrical cords have been in use for decades. Oftentimes, multiple electrical cords must be utilized in order to transmit electrical power from a fixed power source to a distantly removed work site where power equipment is being employed. For example, in many residential and commercial construction sites, workmen must utilize a fixed source of electrical power to power various power tools which are used at locations which are located remote from the fixed source. A persistent problem in utilizing multiple electrical cords which are connected in series is the maintenance of the integrity of the interconnection of the contiguously positioned cords. Though extensive efforts have been made in the past to design and construct plugs which impart a measure of structural strength and integrity to any intercooperative union of adjacently positioned cords, it has been found that oftentimes the cords become separated due to the forces which are imparted to the cords by the user working with a power tool at the free end of the cord. Further, it should be recognized that due to the weight of the cord involved, oftentimes the cords become separated during the act of merely rolling out the cords to extend them from the power source to the work site location.

Various attempts have been made in the art to design and construct structures which would be capable of retaining a plug connection of two contiguously positioned electrical cords. Oftentimes these structures have been formed of rigid housings which were adapted to receive the two interconnected plugs within a hollow cavity defined within the housing. Thereafter the housing is closed to encapsulate the plugs. The use of rigid housings apparently was viewed as a prerequisite for insuring that the housing had sufficient strength to insure the maintenance of the engagement of the two plugs.

While previous constructions may have provided some degree of integrity to the interconnecting plugs, it has been found that the rigidity of the housings posed another problem. At many industrial and/or residential work sites, the housings were subjected to environmental hazards of a nature which often resulted in their being damaged or totally destroyed. For example, the housings are typically positioned on the ground. There, they are subject to being run over by utility vehicles such as pickup trucks. Owing to the rigid nature of the housing construction, these housings were often broken or shattered by the force of the truck running over them.

Attempts at reformulating the structural nature of the housings by using more flexible material such as rubber posed another problem in that housings manufactured from flexible materials were unable to retain the plugs in their intercooperative engagement.

It should be recognized that the inadvertent disconnection of electrical cords which are conjoined one to another to reach an extended distance may cause a considerable loss of work time and may pose a danger to workmen. The power tools being operated by the power received through the cords may pose a hazard to workmen if they are suddenly and without warning deprived of electrical power. Furthermore, the disruption in work time caused by the disconnection of the electrical cords poses a significant problem to workmen in the field in that they must oftentimes cease working and take time to reconnect the cords.

In view of the need of maintaining the integrity of the intercooperated plugs of conjoined electrical cords, there continues to exist a need for a retainer adapted for securing the plugs of conjoined power cords while simultaneously resisting the environmental hazards which exist at work sites.

SUMMARY OF THE INVENTION

A housing adapted for receiving and retaining a pair of conjoined electrical power cords is disclosed. The retainer includes a housing formed of an elongate section having a pair of ear-like members secured thereto. The ear-like members are symmetrically positioned about the elongate section to extend laterally therefrom. The housing is formed of a flexible material preferably a two-layer structural material having an inner surface formed of a rubber-like material having a high coefficient of friction associated therewith and a outer surface formed of a material which is longitudinally non-stretchable. The outer surface material is conjoined or bonded to the inner surface material, i.e., the rubber-like material. The outer surface material precludes the inner surface material and hence the housing from being stretched longitudinally. This provides a degree of strength and rigidity to the housing. An elongate reinforcement strip is mounted on the housing, preferably to the elongate region to extend along the length thereof. The reinforcement strip is fabricated longitudinally of a material which is non-stretchable along the length of the strip. The use of the strip imparts a rigidity to the housing, specifically the elongate section thereof. The reinforcement strip is adapted to preclude any longitudinal distortion or elongation of the housing.

The housing defines two oppositely positioned edges. These edges are formed in part by an edge of the elongate section as well as an edge of the ear-like section which is conjoined to the elongate section. A connection means, e.g., a zipper, is secured to the opposing edges of the housing and provides a means whereby the edges may be interconnected one to another to thereby form a generally hollow, elongate tubular structure. The tubular housing defines two opposing openings proximate the first and second ends of the elongate section. Each of the openings is adapted to receive a plug fitted section of an electrical power cord. The plug of each power cord may be inserted into the hollow interior region of the housing. Pull tabs are mounted on each end of the elongate section of the housing to form a means whereby the user may grasp the housing while operating the zipper or the connection means.

A length-adjustable loop is secured to the outer surface of the housing preferably proximate the reinforcement strip. The loop is adapted with an interconnection means. This interconnection means is releasably disjoinable whereby the loop may be opened or closed for permitting the storage thereon of the power cords which have been interconnected by the retainer. The loop, in association with the retainer, forms a construction which is adapted not only for securing the two electrical cords together but furthermore for providing a structure adapted to retain the coiled electrical cords in a orderly and secured arrangement suited for easy carrying by the user.

In an alternative construction of the invention, the housing is mounted on an auxiliary housing which is specifically configured to receive and retain a rigid cover plate of the type typically found covering an electrical wall power outlet in a conventional residential or commercial wall. In this alternative construction, the retainer is adapted for retaining the integrity of the connection of an electrical power cord with an electrical wall outlet. The retainer is secured to its auxiliary housing, for example, by flexible fabric strips which are secured to the housing and to the secondary housing. The auxiliary housing is specifically adapted to receive and retain a rigid cover plate and to establish a secure interconnection of the rigid cover plate and the electrical cord-retaining housing. In this alternative construction, the housing is adapted with a single entry inlet for purposes of inserting the electrical power cord and its associated plug. As in the previously described construction, a tab is mounted on the end of the elongate section of the housing to provide the user with the means of grasping the housing while the housing connection means are operated.

In this first alternative construction, the auxiliary housing may also be fitted with a plurality of first electrical cord retaining housings, preferably in number to correspond with the number of electrical plug outlets configured within the coverplate.

A second alternative construction of the instant invention is adapted for a multiple plug fixture to which a single power supplying cord is adapted. The multiple plug fixture is constructed for providing power to a plurality of electrical power cords. In this particular construction, the housing of the invention, which is substantially similar in configuration to the above-described principal e embodiment, may be fitted with a plurality of radially extending reinforcement strips which function in cooperation with a primary elongate reinforcement strip to provide a degree of integrity to the housing and thereby prevent the housing's distortion, which distortion could lead to a separation or disconnection of the intercooperated power cords.

DETAILED DESCRIPTION OF THE ILLUSTRATED EMBODIMENTS

Figure 1:
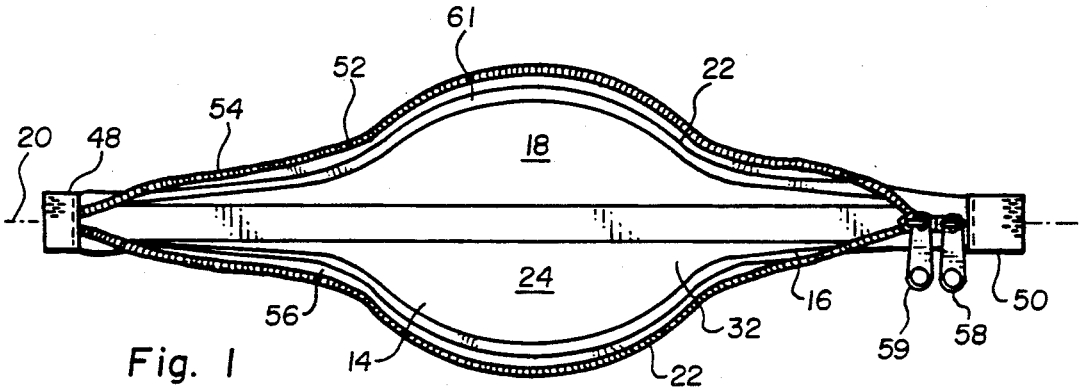
FIG. 1 is a top plan view of an electrical cord retainer housing of the instant invention shown in an open configuration.
Figure 2:
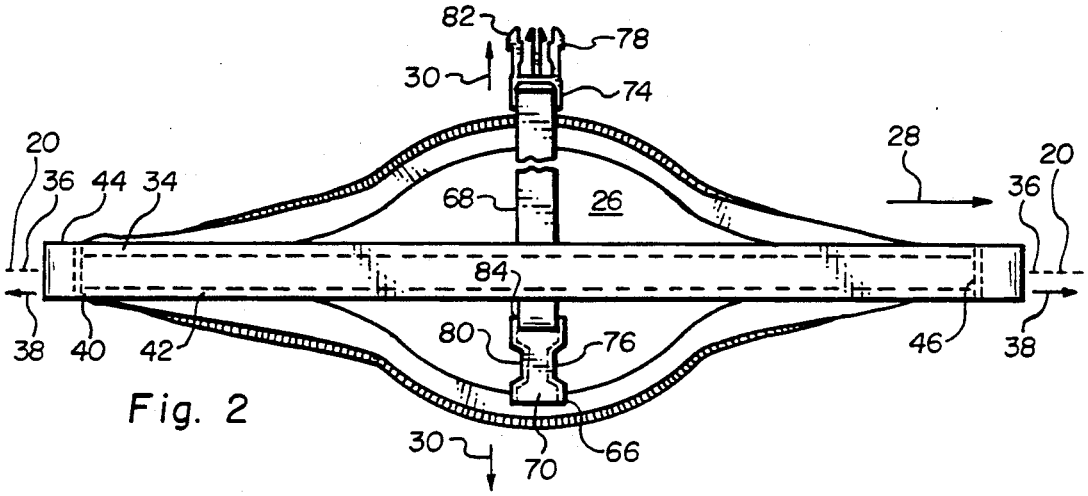
FIG. 2 is a bottom plan view of the retainer housing of FIG. 1 likewise shown in an open configuration wherein the length-adjustable loop has also been opened.
Figure 3:
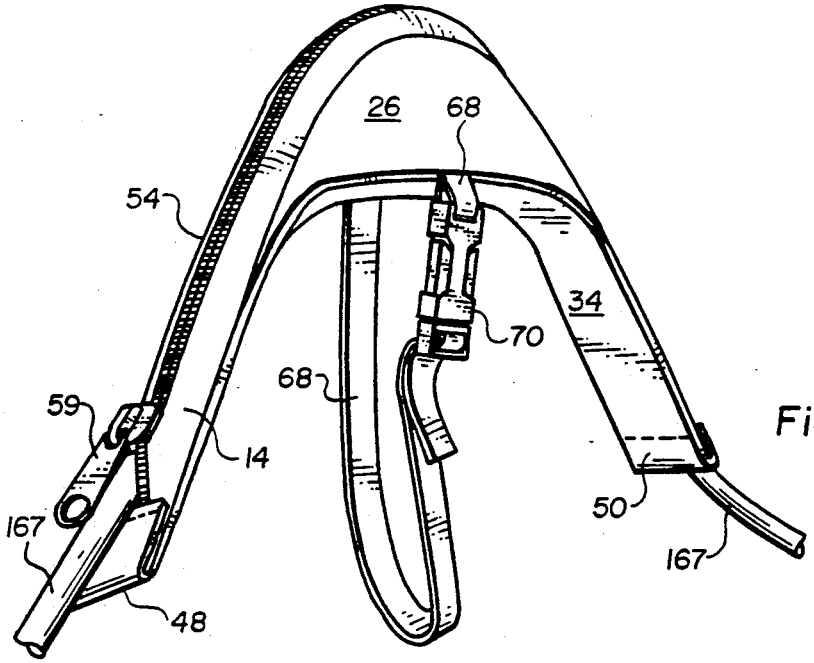
FIG. 3 is a perspective view of an electrical cord retaining housing of the instant invention showing a pair of electrical cords being received and retained within the housing, the length-adjustable loop shown in a closed orientation.

As shown in FIGS. 1, 2 and 3, a first embodiment of the electrical cord retaining apparatus of the instant invention includes a housing, a reinforcement member, and a connection means adapted to secure the housing in a tubular shaped condition.

The Housing

As shown in FIGS. 1 and 2, the housing 14 of the invention includes a integral sheet member 15 having a elongate, generally rectangularly configured central region 16 and a pair of ear-like members 18 which are integrated with the central elongate region 16. The ear-like members 18 are generally semi-circular in configuration wherein the curved portion of the ear-like member is oriented to extend laterally outward from the central elongate member 16 and hence the longitudinal axis 20 of the central elongate region 16. As shown in FIG. 1, each of the ear-like members 18 are oriented substantially symmetrically with respect to one another about the longitudinal axis 20. The housing 14 includes a pair of oppositely positioned, opposing edges 22. Each of the edges 22 is formed in part by a portion 23 of the ear-like section 18 as well as a portion 25 of the exterior exposed edge of the central elongate region 16. The edge 22 is formed by two segments of the edge of the central elongate region and the central portion. The central portion of the edge 22 is formed by the generally semicircular configured perimeter of an ear-like member 18. The housing 14, as previously described, is preferably constructed as an integral member. The inner surface 24 of the housing is fabricated of a material having a high coefficient of friction which when abutted against a plug on an electrical cord resists the movement of a electrical cord or its associated plug along the surface thereof. In preferred constructions, the interior surface 24 is fabricated of a rubber or rubber-like material. Bonded to the interior surface 24 is an exterior surface 26 as shown in FIG. 2. Surface 26 is preferably fabricated from a material which is constructed to be longitudinally non-stretchable, i.e., in the direction indicated by arrows 28. Preferably, the material constituting surface 26 is stretchable in the direction indicated by arrows 30. The material forming surface 26 is securely bonded to the material forming inner surface 24 whereby the material 26 precludes the stretchability of the inner material 24 in the directions indicated by arrow 28 while permitting the material which forms surface 24 to stretch in the directions indicated by arrows 30 as shown in FIG. 2. The use of this particular combination of materials provides a housing which is adapted to retain a pair of conjoined plugs in the central region 32 of the housing 14. The material of the housing is also adapted to stretch about that pair of plugs and form a tight enclosure thereabout. The housing is constructed such that its stretchability or otherwise its capability to be distorted in the directions indicated by arrow 28 in FIG. 2 is markedly reduced if not totally eliminated.

The Reinforcement Strip

As shown in FIGS. 1 and 2, an elongate, rectangularly configured reinforcement strip 34 is securely mounted on the exterior surface of the housing 14 along the elongate central section 16 of that housing. As shown particularly in FIG. 2, the longitudinal axis 36 of the reinforcement strip 34 is oriented collinear with the longitudinal axis 20 of the housing. The reinforcement strip 34 is preferably fabricated of a flexible fabric material which though flexible, is largely resistant if not totally resistant to stretching or elongation in the directions indicated by arrows 38, i.e., the reinforcement strip is not longitudinally stretchable. The reinforcement strip 34 secured to the housing 14 by means of sewing 40. The sewn stitching extends along the length of the reinforcement strip 34 proximate an edge 42 of that strip. The stitching extends approximately from one end of the housing 44 to the opposing end of the housing 46. As shown to advantage in FIG. 2, the stitching is performed on both the opposing sides of the reinforcement strip, and furthermore is done at the ends of the strip thereby interconnecting the opposing stitching from each side of the strip. In a preferred construction, the reinforcement strip 34 is doubled back on itself, i.e., in a fashion similar to a hem, at each of the ends 44 and 46 as shown to advantage in FIGS. 1 and 2. The doubling back and then the securing of the ends of the reinforcement strip to the housing 14 as well as to the reinforcement strip 34 itself forms a pair of oppositely positioned tabs 48 and 50. Each of the tabs 48 and 50 is positioned at a respective opposing end of the housing and serves as a means of assisting the user in operating the retainer. As shown particularly in FIGS. 1 and 3, the ends of the housing 14, in their securement to the tabs 48 and 50, are generally formed whereby the outward edges of the housing are turned back on the housing itself and are secured along an end of the housing to form a generally tubular end structure.

The Connection Means

The third principal element of the retainer construction is a connection means secured to the housing to permit the user to open or alternatively close the housing about a pair of conjoined electrical cords. As shown to advantage in FIGS. 1, 2 and 3, a zipper 52 having a pair of toothed tracks 54 is securely mounted to the housing. One of the tracks 54 is mounted on each of the opposing edges 22 of the housing 14. These two tracks are adapted to be inter-engaged or cooperated one with the other by means of a zipper pull 58 which is mounted on the tracks. In a preferred construction shown in FIG. 1, the zipper is fitted with two zipper pulls 58 and 59. The use of the two zipper pulls permits a construction whereby the two zipper pulls may be positioned proximate the point 61 on the housing. Subsequent to the introduction of the electrical cord plugs into the housing and their securement with the other, one of the zipper pulls may be displaced outwardly towards end 46 while the opposing zipper pull 59 may be displaced outwardly towards the end 44 of the housing. As the two zipper pulls approach their respective ends, the housing is forced to form a tubular envelope having a hollow interior with a diameter approximately equal to that of the electrical cord and plugs. The zipper pulls cause the housing to be constricted about the circumference of the electrical cord and form a secure pressure-type connection therewith. The zipper, as shown in FIGS. 1 and 2, may be of a conventional construction with the exception of having two zipper pulls mounted thereon. Preferably, the zipper is sewn to the edge 22 of the housing 14, though other means of mounting the zippers to the housing may equally be adopted.

Carrying Loop

Figure 5:
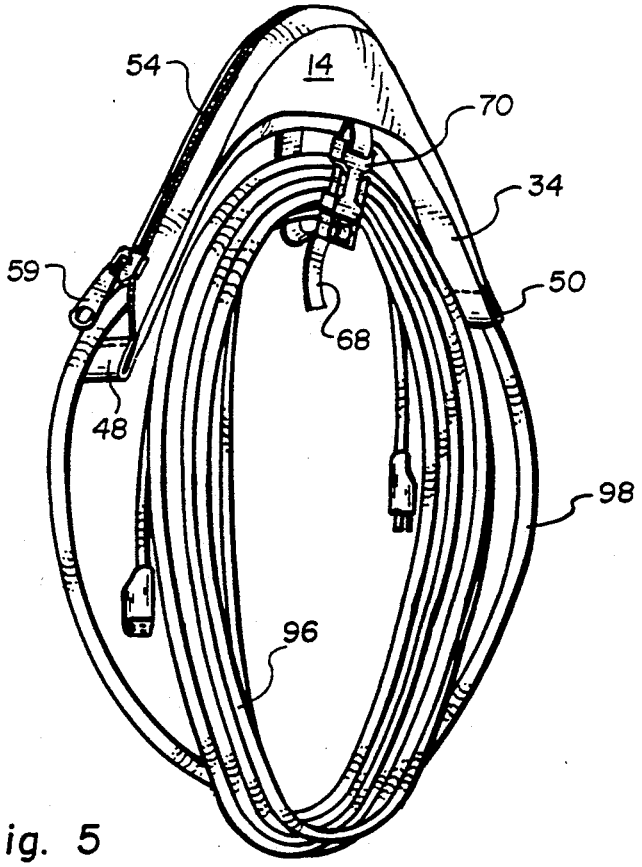
FIG. 5 is a perspective view of the retainer housing of FIG. 3 illustrating the storage of a pair of electrical cords on the storage retainer loop which has been secured to the retainer housing.

According to the invention, a further structural element which may be included with the retainer is a loop 66 which may be fitted to the exterior surface of the retainer housing and thereby form a means of carrying a coiled-up single or plurality of electrical cords as shown in FIG. 5. The carrying loop 66 forms a means whereby the retainer can be used as a means of retaining the coiled up electrical cord in a ordered and untangled condition. The retainer provides a means whereby the user can readily secure the cords together at their ends within the housing itself and thereafter strap the carrying cord around the coiled up remainder of the electrical cords providing a means whereby the entire electrical cord assembly may be carried with ease and in an untangled fashion.

As shown to advantage in FIGS. 2 and 3, the carrying cord 66 includes two principle elements, a flexible elongate strap 68 and a connection means 70 which is secured to each of the opposing free ends of the strap 68. As shown to particular advantage in FIG. 2, the strap 68 is a generally rectangularly configured element, preferably fabricated of a flexible, yet strong, fabric material. The strap 68 is secured to the housing 14 by its interdisposition between the outer surface 24 of housing 14 and the reinforcement strip 34. It follows that as the reinforcement strip is sewn to the housing 14, the stitching also secures the strap 68 to the housing 14. At each of the opposing ends 72 and 74 of the strap 68 is secured a releasably detachable connection 70. The connection 70 may be of any conventional construction. In the embodiment shown in FIG. 2, the connection 70 includes a female receptacle 76 defining a hollow interior therein which is specifically configured to receive a pair of deformable male prongs 78 which are secured on the end 74 of the strap 68. As the male prongs 78 are inserted into the hollow cavity 80 of the member 76, the prongs 78 are urged toward one another sufficiently to permit the entry of the prongs into the hollow cavity 80 of the female connection 76. After sufficient penetration of the male members, the hollow cavity 80 opens sufficiently to thereby permit the outwardly extension of the male members. The heads 82 of each of the male members may be engaged against a ledge 84 defined within the female housing to form a secure engagement thereof sufficient to retain the male members secured within the female housing. FIG. 3 illustrates the interconnection of the two members of the connection means to form thereby a generally circular configured loop which may thereafter as shown in FIG. 5 be utilized to retain one or more electrical cords.

Figure 4:
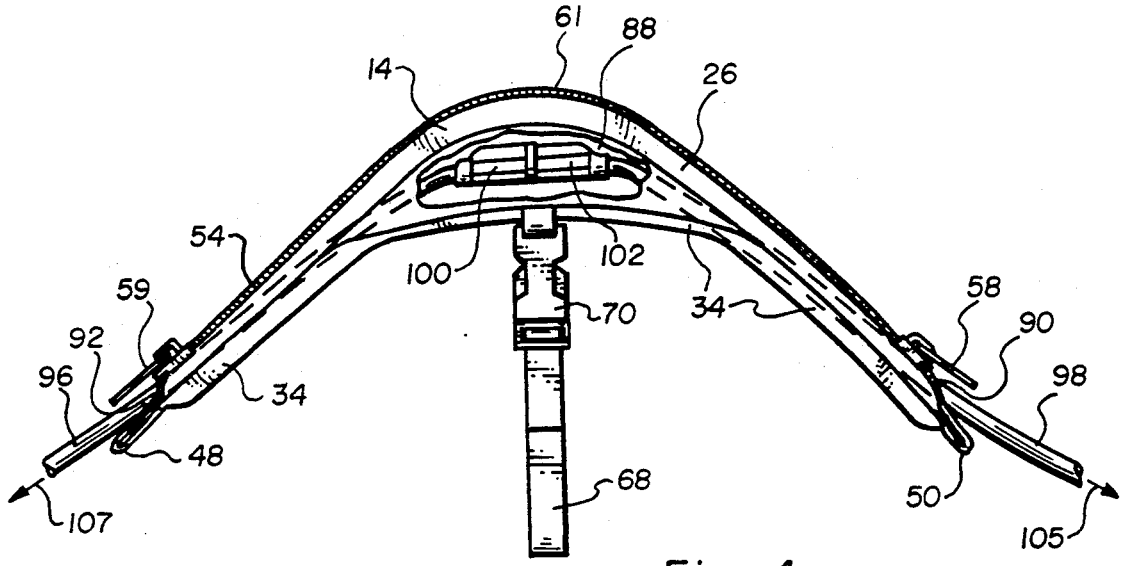
FIG. 4 is a side view shown in partial section of the retainer housing of FIG. 3.

FIGS. 3 and 4 illustrate the operation of the retainer housing. As shown to advantage in FIG. 4, the housing defines an interior cavity 88 which is specifically dimensioned to receive a pair of oppositely directed electrical cords and their associated plugs. The interior 88 of the housing is accessed by means of variably dimensioned inlet ports 90 and 92 which are defined by the displacement of the zipper pulls 59 and 58 as they move along their respective tracks 54 which are, as shown in FIGS. 1 and 2, securely mounted on the outwardly extended edges 22 of the housing 14. As shown to advantage in FIG. 3, the inlet port 92 may be enlarged or alternatively restricted in dimension as the zipper pulls 58 and 59 proceed along the zipper track. In a preferred operation, the zipper pulls 59 and 58 are initially positioned on the zipper track at a location indicated by lead number 61. In this particular orientation, the zipper tracks are disengaged from one another and thereby may by pulled outwardly away from one another to expand the dimension of the circumference of the inlet ports 90 and 92 defined thereby. A respective electrical cord 96 and its attendant plug 98 may thereafter be inserted into a respective port 92 or 90. Upon bringing the plugs 100 and 102 into the central region of the interior 88 of the housing 14, the plugs are engaged one with the other. The interior 88 is dimensioned so as to permit the plugs to be intercooperative with one another in a conventional manner as shown in FIG. 4. Subsequent to the engagement of the plugs 100 and 102, the zipper pulls 59 and 58 are each displaced along their respective zipper tracks towards the respective ends 44 and 46 of the housing 14. As the zipper pulls are so displaced, they cause the edges of the housing 22 to be brought together. Owing to the construction and dimensioning of the housing 14, as the edges 22 are brought into engagement one against the other, the housing 14 is stretched about the plugs and their associated cords thereby bring the high coefficient of friction surface 24 into abutment against the plugs and their associated cords. As the zipper pulls are further displaced along the length of their tracks towards their respective ends, the housing is formed into a generally tubular, somewhat "U"-shaped configuration as shown in FIG. 4 thereby enclosing the plugs and a length of their respective cords. The portions of the housing, and more specifically the central elongate region of the housing, is dimensioned such that the zipper pulls are displaced towards the ends, the dimension or circumference, i.e., the cross sectional area of the tubular interior of the housing, is constricted in size until eventually the dimensioning of that circumference corresponds generally with the circumference of the respective electrical cord 96 or 98. This particular dimensioning leads to a constriction of the housing about the cord, thereby bringing the high coefficient of friction surface in abutment with the cord, and furthermore providing a constriction type connection of the housing with the cord.

As shown in FIG. 4, the construction of the housing, together with its reinforcement strip 34, is such that upon the securement of the housing 14 about the electrical cords 96 and 98, a generally "U"-shaped configuration is formed. The reinforcement 34 is positioned such that any distortion in the housing in a longitudinally directed fashion as indicated by arrows 105 and 107 is markedly reduced if not eliminated. It follows that any attempt to disjoin the electrical plugs by a force imparted to one or both of the electrical cords is resisted at multiple points throughout the retainer housing. For example, each of the constriction-type bonds formed at the interface of the respective zipper pulls provides a high coefficient of friction type union of the electrical cords with the housing. This interconnection in association in conjunction with the longitudinal rigidity afforded by the reinforcement strip 34.

Figure 6:
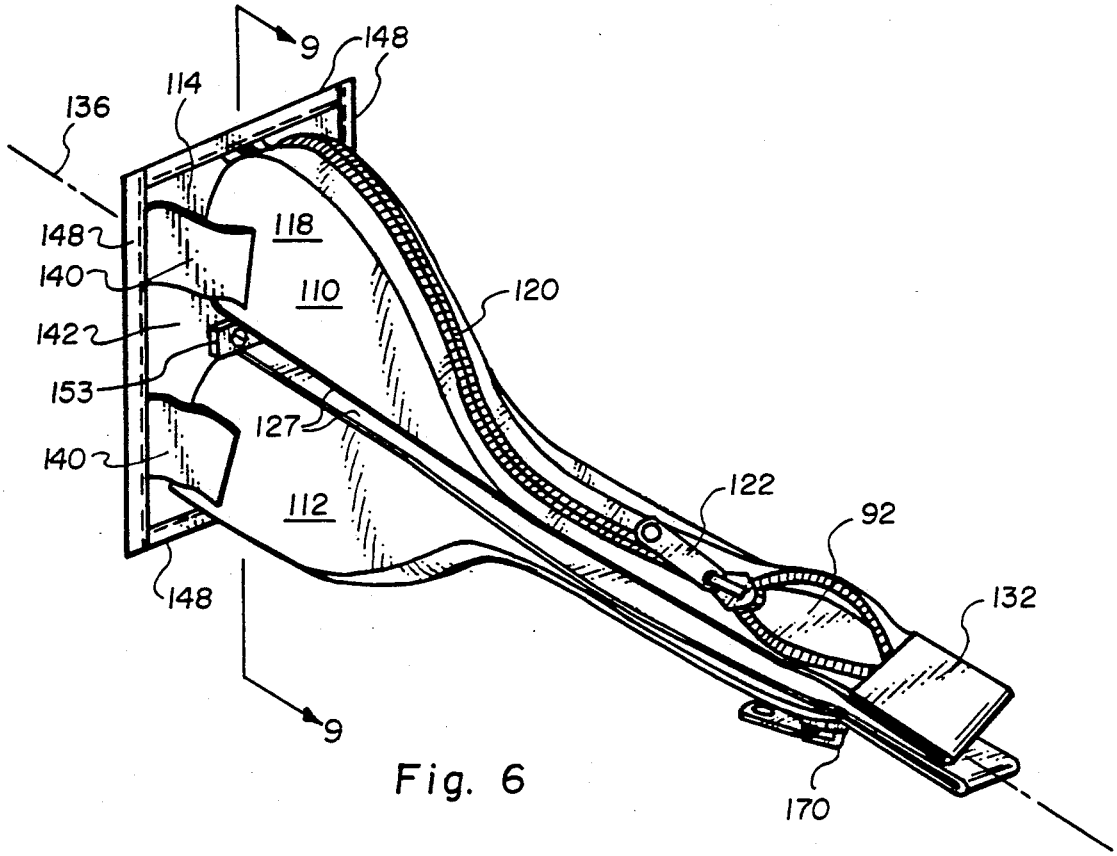
FIG. 6 is an elevated perspective view of a first alternative embodiment of the retainer housing of the instant invention which is specifically adapted for securing electrical power cords in connection with a wall-mounted electrical outlet.
Figure 7:
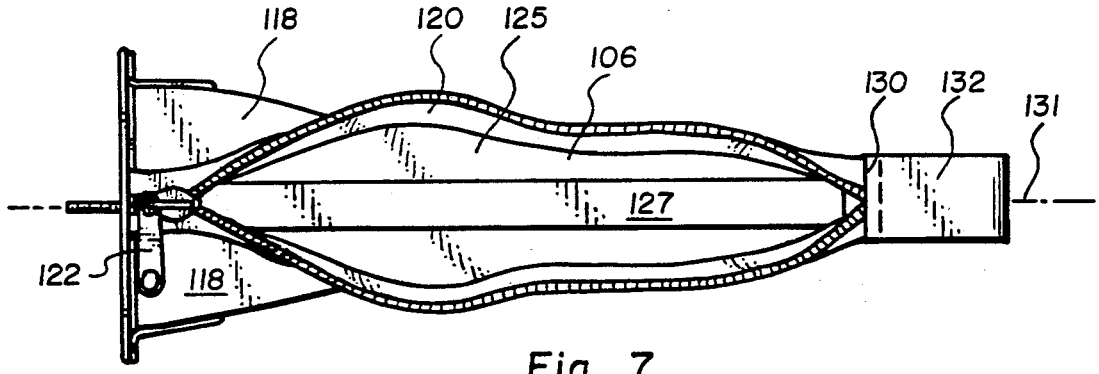
FIG. 7 is a top view of the first alternative embodiment of FIG. 6 illustrating the housing in an opened configuration.

A second embodiment of the invention is illustrated in FIGS. 6 through 11. This particular embodiment is adapted for retaining an electrical cord, and more specifically the plug of that cord, in cooperative engagement with a conventional wall outlet. As shown in FIG. 6, the second embodiment includes a first housing 110 and a second housing 112 which are secured against an auxiliary housing 114. Each of the housings 110 and 112 are structurally very similar to the previously described housing 14. That is, each housing includes an elongate central region 116 as shown in FIG. 7 and a pair of ear-like members 118 which are integrated with the central section 116 to form a single housing sheet. Each of the ear-like members 118 are symmetrically arranged about the central elongate region 116 similar to the construction previously described. Similarly, the edge of each of the members 118 in association with a respective portion of the central elongate region, specifically the edge thereof, forms a pair of opposing edges which are fitted with a respective toothed zipper track 120. A single zipper pull 122 is mounted on the zipper track 120 and provides a means for alternatively engaging or disengaging the respective zipper tracks and their associated edges of the housing 110 or 112. The zipper track is physically attached, e.g., by stitching, to the auxiliary housing at its first end. The opening defined by the zipper tracks generally 125 defines an opening wherein an electrical cord, more specifically the plug associated therewith, may be inserted and/or retracted. The housings 110 and 112 are each fitted with a reinforcement strip 127 which is sewn to the housing along the longitudinal length of the housing 129 in a manner similar to as previously described in the first embodiment. A longitudinal axis 131 of the reinforcement strip 127 is oriented collinear with the longitudinal axis 129 of the housing 110 and/or 112. Likewise, the reinforcement strip 127 is turned around on itself at its end 130 and is sewn to the reinforcement strip to thereby form a tab 132 on the end of the housing. The user grasp the tab and providing a point of securement for retaining the housing in place while the zipper is displaced along the length of the zipper tracks 120. As shown to advantages in FIG. 6, the housings 110 and 112 are symmetrically arranged about a longitudinal axis 136 and are basically arranged in a mirrored reflection of each other about that axis, i.e., the reinforcement strip 137 of the housing 112 is positioned atop the housing in the orientation shown in FIG. 7, whereas the reinforcement strip 137 in housing 110 is shown on the bottom of the housing. The housings 110 and 112 are secured to the auxiliary housing 114 by four fabric connection strips 140. Each of the housings 110 and 112 has a connection strip 140 secured on either of its opposing sides. These connection strips are preferably fabricated of a non-longitudinally stretchable fabric material which is flexible. Each of the fabric strips 140 is sewn to its respective housing 110 or 112.

Figure 8:
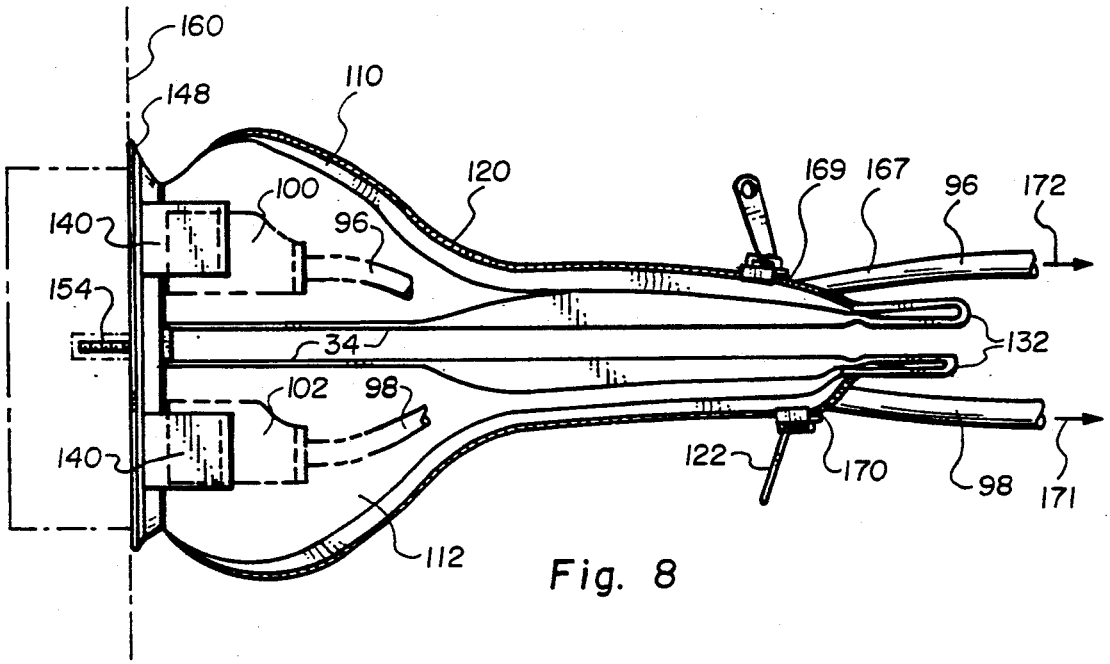
FIG. 8 is a side view of the retainer housing of FIG. 6 shown in partial section in illustrating the placement of electrical plugs against the coverplate secured within the secondary housing of the embodiment.
Figure 9:
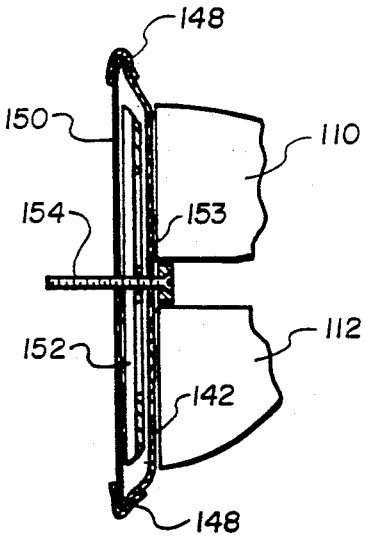
FIG. 9 is a partial sectional view of the retainer housing of FIG. 8.
Figure 10:
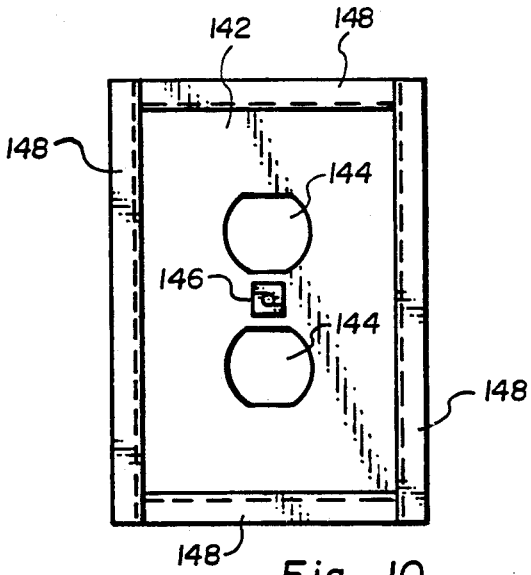
FIG. 10 is a front elevational view of the auxiliary housing of the embodiment shown in FIG. 6.

The auxiliary housing 114 which is shown to advantage in FIG. 10 includes principally a first, generally rectangular panel 142 having a pair of apertures 144 defined therein. Each of the apertures 144 is specifically configured to generally correspond and register with the female electrical connection on an electrical outlet of the type typically found in a wall in a residence or commercial installation. The panel 142 further defines a circular aperture 146 which is defined to receive a plate screw which is adapted for securing the auxiliary housing against the structure of the wall outlet. A border element 148 is sewn to the peripheral perimeter of the panel 142 to form a generally rectangularly perimetered border about the plate panel 142. As shown to advantage in FIG. 10, the border 148 consists of four distinct members which are connected one another at their respective ends to form a generally rectangular perimetered border. As shown to advantage in FIG. 9, the panel 142 and its associated border 148 are mounted to a back panel 150 which is also generally rectangular in configuration and largely similar in shape and dimension to panel 142. Panel 142 defines apertures corresponding to apertures 144 and 146. The back panel 150 is sewn to the borders 148 along the perimeter of the panel 150 to form an enclosing sheath for a rigid cover plate 152 which is positioned within the interior of the sheath formed by the panels 142 and borders 148 and back panel 150. The plate 152 is of a conventional construction type which usually covers residential and industrial electrical wall outlets. The cover plate 152 is adapted to be secured against the wall by means of a screw 154 which passes through the apertures 146 in panel 142 and through a corresponding aperture in panel 150. A rectangular washer 153 may be interposed between the head of the screw 154 and the fabric panel 142. Upon the placement of the screws through the central aperture 158 defined in the cover plate 152, the plate and its associated sheath may be secured against the wall. A washer 153 is interposed between the head of screw 154 and the panel 142 to assist the screw in securing the structure to the electrical wall outlet. FIG. 8 illustrates the positioning of the retainer of the second embodiment against a wall 160. As shown, the screw 154 is inserted into a respective female threaded aperture defined within the wall-mounted structure of the wall outlet. As shown to advantage in FIG. 8, the electrical cords 167 are passed through the aperture 125 and are thereafter plugged into the wall-mounted electrical outlet. Subsequently the zipper pulls 122 are displaced along the length of their respective zipper tracks 120, thereby stretching the retainer housing about the plug and its associated cord. Similar to the previously described embodiment, the housing 110 and 112 are dimensioned such that upon the displacement of the zipper pull, the housings are stretched about the cord and its associated plug in a rather tight abutment whereby the high friction coefficient of friction surface of the interior of the housing is brought into abutment against the plug and its cord to provide a friction-type union of the plug and the housing. Furthermore, as the zipper pull is pulled along the length of the associated zipper track, due to the dimensioning of the housing, the zipper pull soon constricts the housing about the cord to provide a friction fit of the housing with the cord itself, as indicated in FIG. 8 at locations 169 and 170. During this process the user may avail himself of the tabs 132 for purposes of holding the retainer in place and providing the means of easily operating the zipper pulls. This particular second embodiment is specifically adapted for retaining plugs in electrical connection with an appropriate wall-mounted electrical outlet and thereby retaining those plugs against being dislodged from their electrical connection from those wall outlets by forces applied to the cords in the directions indicated by arrows 171 and 172.

Figure 11:
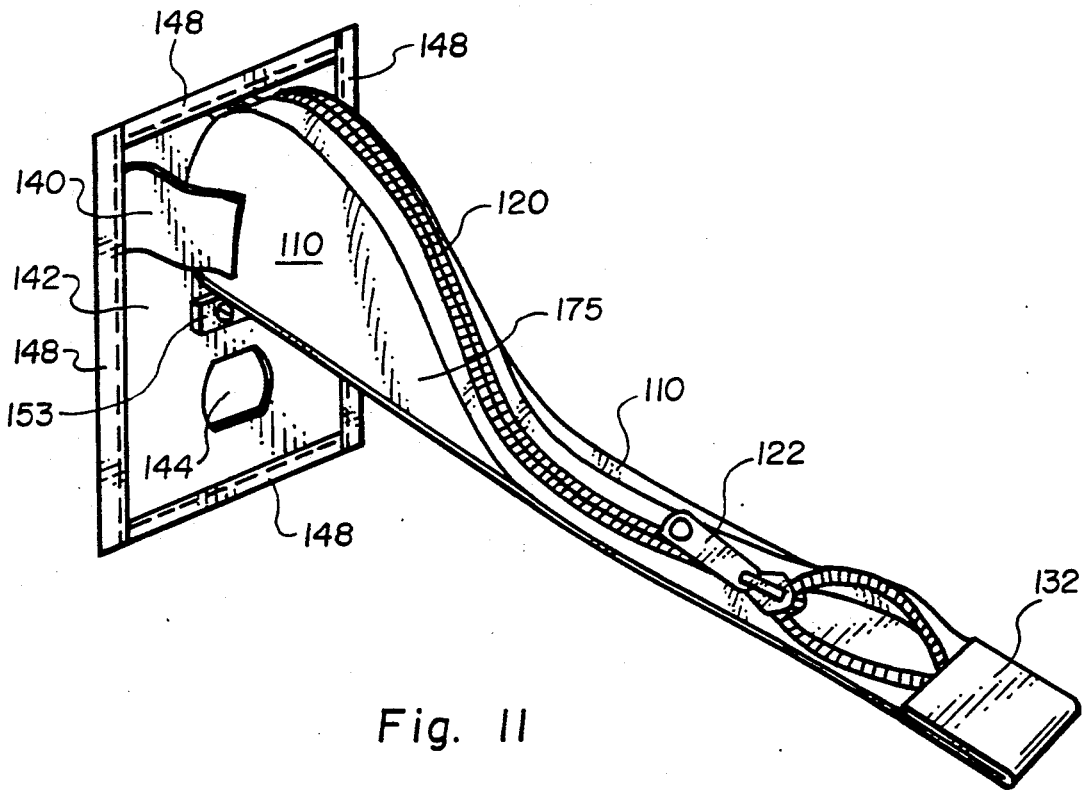
FIG. 11 is a perspective view of an alternative construction of the embodiment of the invention illustrated in FIG. 6.

FIG. 11 illustrates an alternative construction of the embodiment of FIGS. 6–10. In this embodiment, a single retainer 175 is secured to the plate 150. As shown this retainer is essentially identical to one of the housings illustrated in the embodiment of FIG. 6. The principle difference between the two embodiments is the maintenance of one of the electrical outlets, accessed through aperture 144 of plate 150, free of a retainer structure. It should be understood that the invention may be adapted for use with electrical outlets having more than two outlets e.g. outlets having 3, 4, etc. The invention could be adapted with a number of retainers to correspond to the number of outlets provided by the electrical installation.

Figure 15:
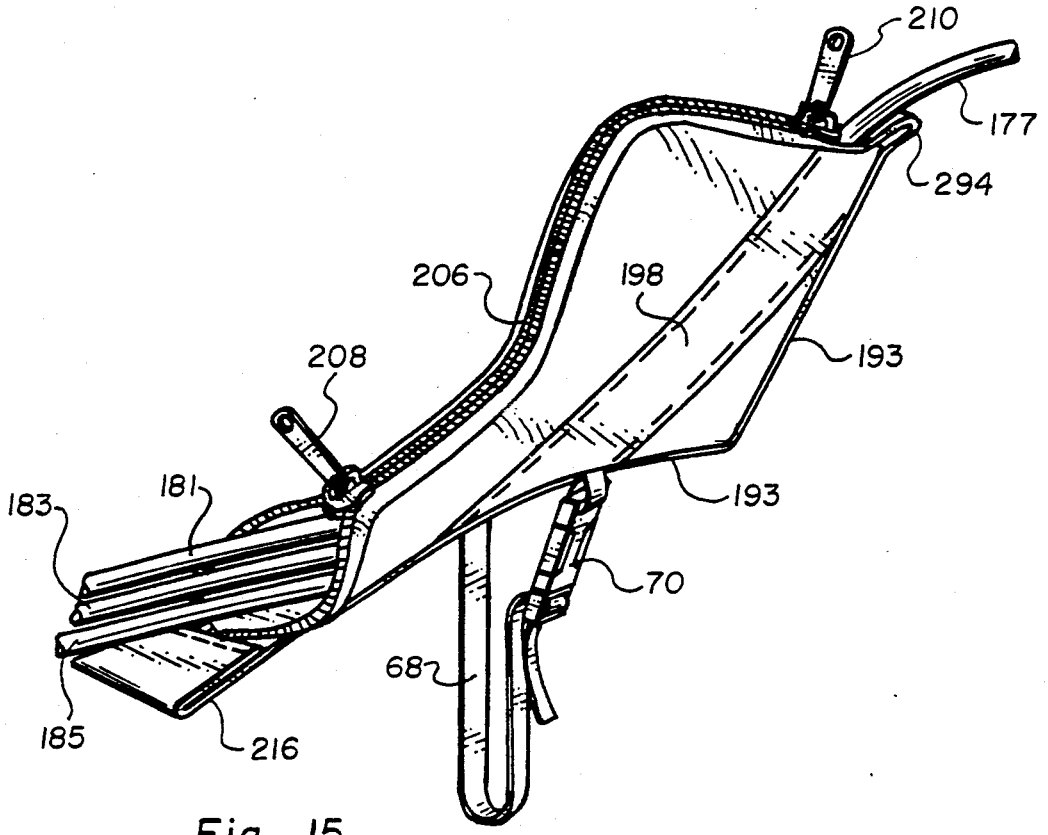
FIG. 15 is a perspective view of the second alternative embodiment of the instant invention illustrating the reception therein of four power cords with the housing shown in a closed configuration.
Figure 16:
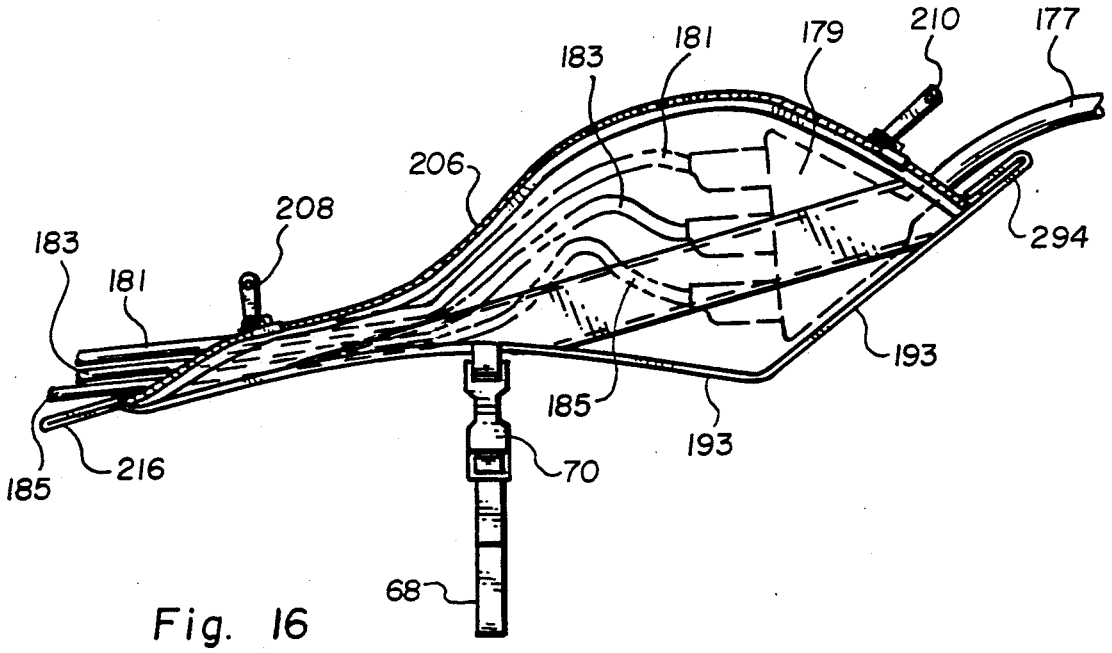
FIG. 16 is a side view of the second embodiment of the invention as illustrated in FIG. 15 showing in partial section the reception and retention therein of a multiple plug electrical connection.

The third embodiment of the instant invention is illustrated in FIGS. 12–16. In this particular embodiment, the retainer is adapted for use with a plug having the capacity for engaging a plurality of individual power cords as illustrated in FIG. 16. In this particular embodiment electrical cord 177 is fitted with a multiplug fixture 179. A number of power cords 181, 183, 185 are thereafter plugged into engagement against fitting 179 to provide power from the power supplying cord 177. Reverting to FIGS. 12 and 13, the housing 180 of this particular embodiment includes an elongate central region 182 and a generally semicircular ear-shaped section 184 which is integrated with this central elongate section 182 to form a housing. The housing may be formed as previously described of a first sheet of material which forms an interior surface for the housing fabricated of a material having a high coefficient of friction, e.g. rubber or rubber-like material. The exterior surface is formed by fabric which is non-stretchable in the directions indicated by arrows 192 and yet is flexible in the directions indicated by arrows 194.

Figure 12:
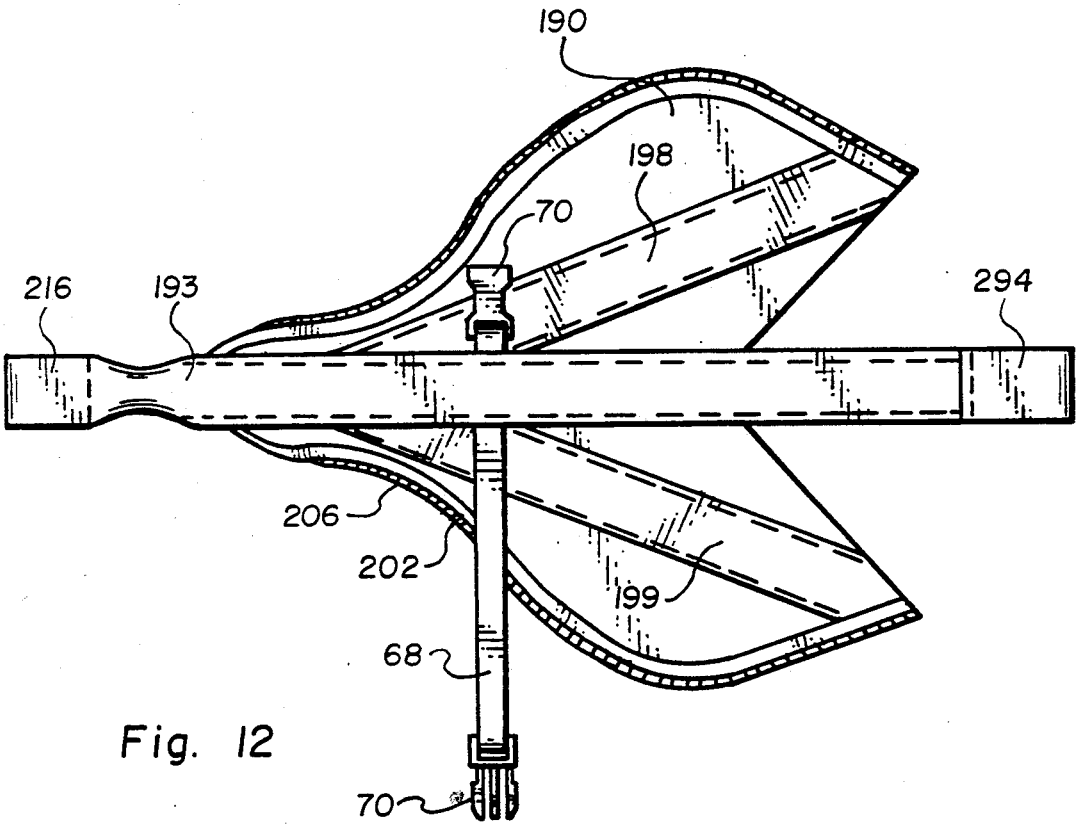
FIG. 12 is a bottom plan view of a second alternative construction of the retainer housing of the instant invention shown in an unassembled condition.
Figure 13:
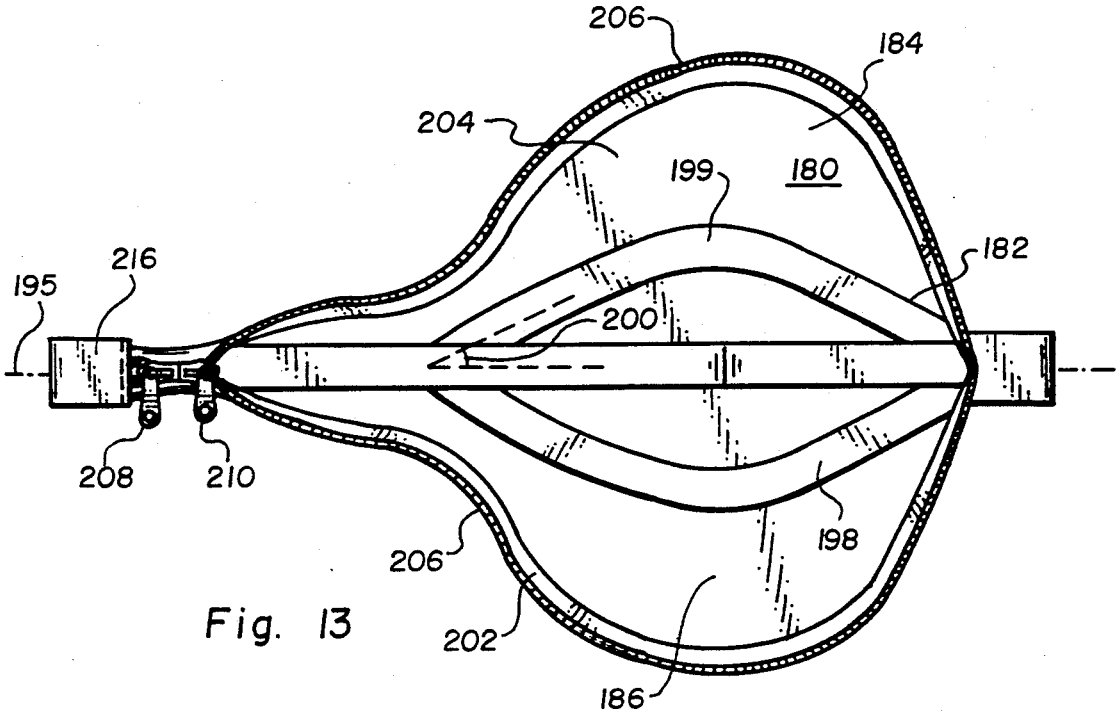
FIG. 13 is a top plan view of the second alternative embodiment of the instant invention shown in an assembled open condition.
Figure 14:
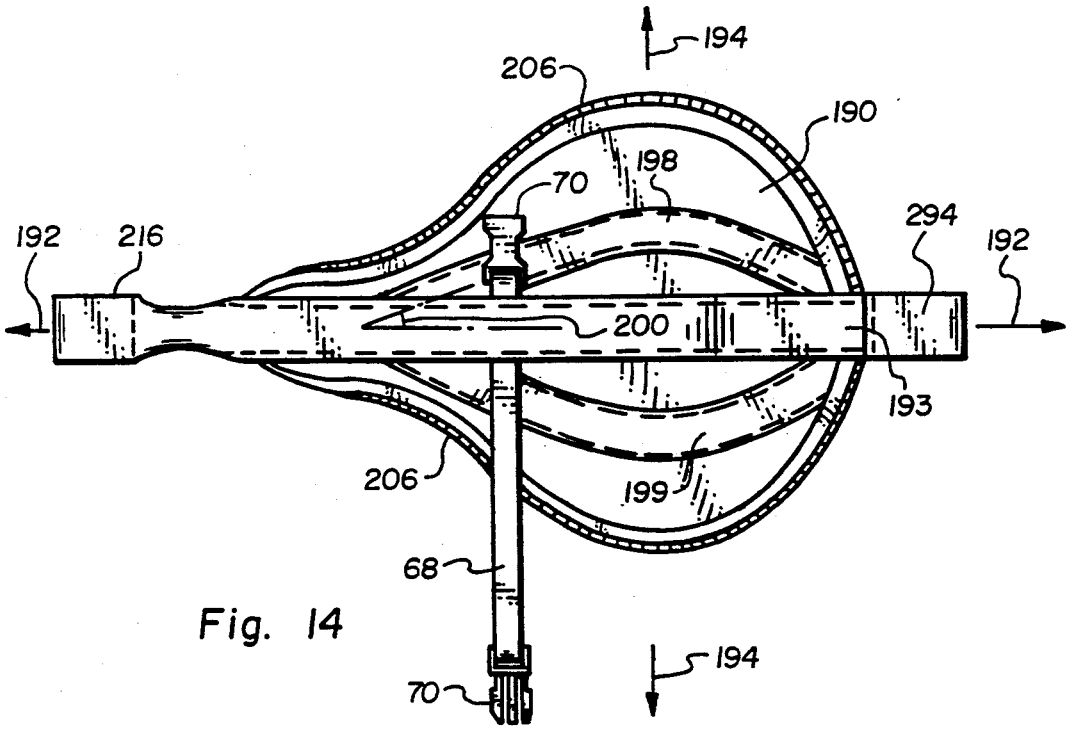
FIG. 14 is a bottom plan view of the second alternative embodiment of the instant invention shown in an assembled open configuration with the length-adjustable loop thereof also shown in an open configuration.

As shown in FIG. 12, the central region 182 of the housing defines two linear edges 181. FIG. 12 illustrates the housing prior to its final assembly when the two edges are sewn each respectively to the reinforcement strip 193 to form the assembly illustrated 15 and 16. As shown in FIGS. 15 and 16, the reinforcement strip and the housing form an angulated configuration which is associated with the zippered edge of the housing forms a receptacle into which the plug 183 is received and retained.

The housing is fitted with an elongate rectangular reinforcement strip 193 which is non-stretchable along its longitudinal axis 195 as previously described in the other embodiments of the invention. The action of the reinforcement strip is supplemented by a pair of supplemental reinforcement strips 198 and 199 which are sewn to the exterior surface 190 of the housing 180 in a generally diagonal or angulated fashion from the primary reinforcement strip 193 at an angle shown by lead line 200. This angle may vary from a degree measure of 15 degrees to 35 degrees with 25 degrees being a preferred orientation. The housing defines two opposing edges 202 and 204 which are each fitted with a respective zipper track 206 similar to previously described embodiments. The zipper tacks are fitted with a pair of zipper pulls 208 and 210 which are adapted to be displaced along the length of the zipper tracks thereby bringing them into either engagement or disengagement. The central reinforcement strip 193 is turned back on itself on each of its edges and tends to form a pair of opposing pull tabs 214 and 216 which permit the user to grasp them for purposes of stabilizing the housing with the zipper pulls as the zipper is operated.

As illustrated this embodiment is fitted with a retainer strap 68 which may be used to retain a coiled cord. Alternatively the strap may be positioned about the housing similar to the manner shown in FIG. 19 to provide an auxiliary retaining structure for exerting a force on the cords contained within the housing.

Figure 17:
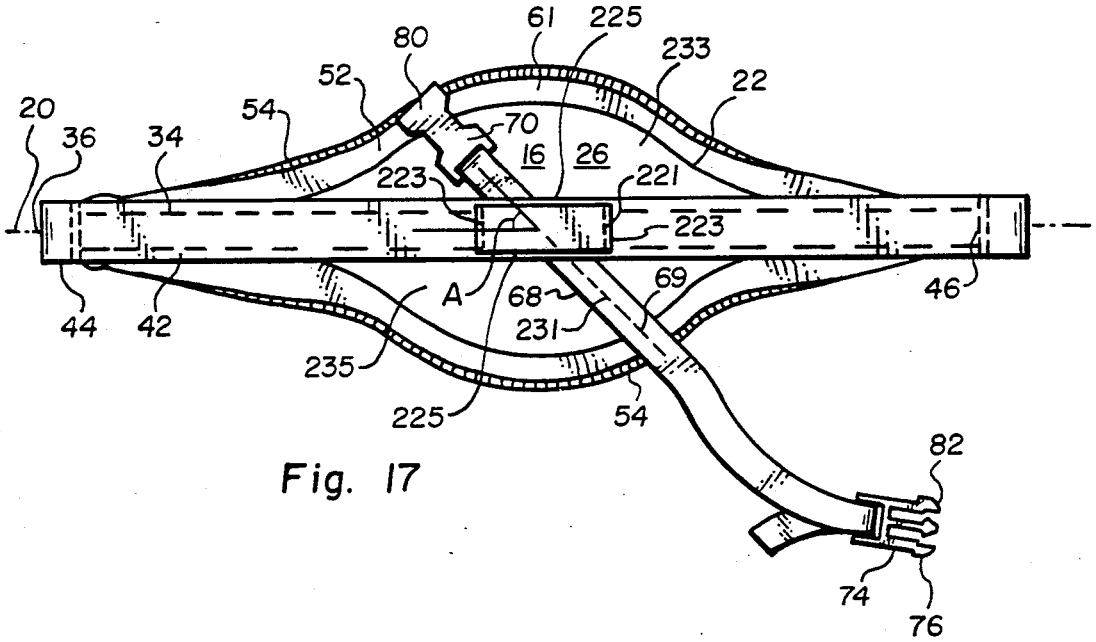
FIG. 17 is a bottom plan view of the retainer of FIG. 3 wherein the strap is mounted at a different orientation on the retainer housing.
Figure 18:
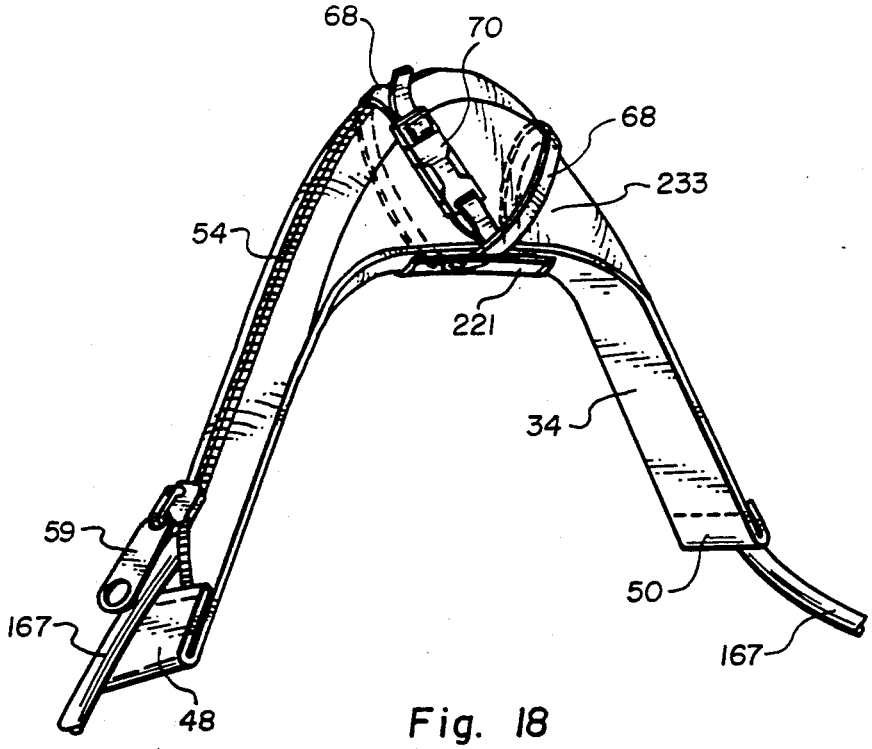
FIG. 18 is a perspective view of the retainer of FIG. 17 illustrating the strap being wrapped about the central region of the housing.

FIGS. 17 and 18 illustrate an alternative construction of the retainer of FIGS. 1–4 wherein the strap 68 is secured to the housing 14 at an angle A to the reinforcement strip 34. In contrast to the retainer of FIGS. 1–4 wherein the longitudinal axis 69 of strap 68 is oriented essential orthogonal to the longitudinal axis 36 of strip 34, in this later embodiment, the angle A is approximately 45 degrees.

A retainer loop 221 is sewn over the reinforcement strip 34 substantially over the intersection of the strap 68 and the strip 34. As shown the retainer loop 221 is a rectangularly shaped element which is shown along its two opposing ends 223 to the reinforcement strip 34. The opposing sides 225 of the retainer loop 221 are not secured to the reinforcement strip 34. As a result, the strap 68 may be pressed between the strip 34 and the overlying retainer loop 221.

The strap 68 is dimensioned sufficiently long that it may be positioned about the central region 16 of the housing 14 in the arrangement shown in FIG. 18. As illustrated the portion 231 of the strap 68 is positioned along the surface of the retainer as shown in FIG. 17, the strap is then passed over the zipper 54 and is then positioned along the surface 233 of the housing 14. The strap 68 is then passed through the retainer loop 221. The strap is then positioned by the surface 235 of the housing 14. Subsequently, the strap is extended over the zipper 54 and is brought into engagement with the connection means 70. As shown in FIG. 18, the wrapping of the strap 68 about the housing 14 provides a means of constricting the housing about the electrical plugs contained within the housing and thereby applying a force to those plugs which oppose forces being applied to the plugs which may function to disengage the plugs.

Figure 19:
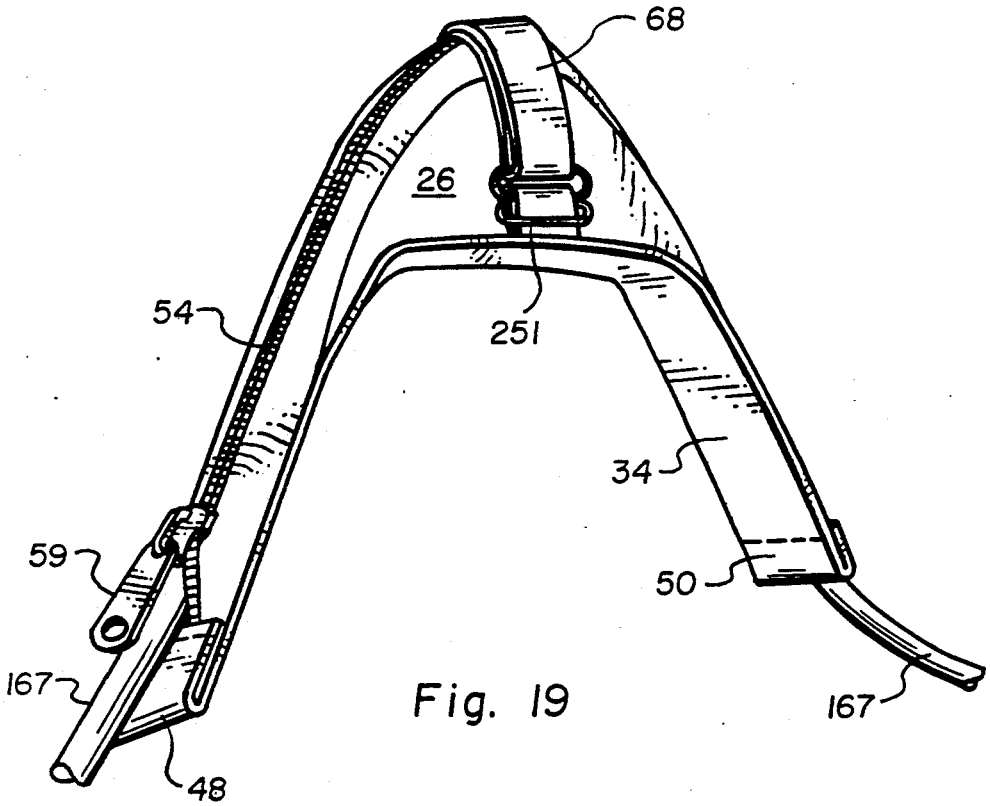
FIG. 19 is perspective view of the retainer of FIG. 3 wherein the strap is illustrated being wrapped around the central region of the housing in an alternative arrangement.
Figure 20:
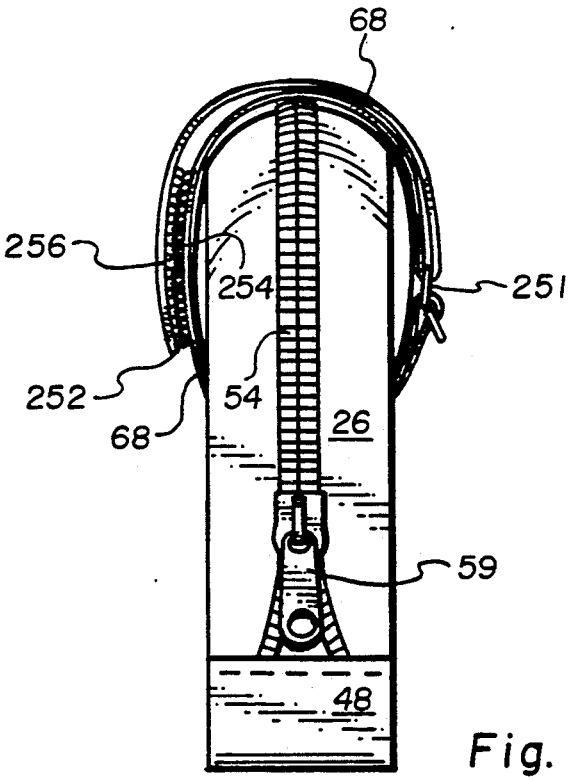
FIG. 20 is a side view of the retainer of FIG. 19.

FIGS. 19 and 20 illustrate an alternative construction of the retainer of FIGS. 1–3. As shown, the strap 68 is adapted for positioning about the central region 16 of the housing 14 so as to encircle that region as shown in FIG. 19. A free end also of the strap 68 is filtered with a loop-buckle 251 through which the opening free end 252 of strap 68 may be inserted, subsequent to its having pressed about the circumference of the central region 16 of the housing 14. The strap 68 is fitted with a hook and pile fastener assembly e.g. of the type sold commercially under the trade designation VELCRO. As shown in FIG. 20, a flexible sheet of hook fasteners 254 is sewn onto a length of the strap 68. A flexible sheet of pile fasteners 256 is sewn onto a separate length of the strap 68 spacedly from the hook fasteners 254. The two sheets are positioned such that the user can wrapped the strap about the central region 16 of the housing 14, insert the free end 252 through the buckle 251, and then turn the strap back on itself to bring the two sheets into engagement one with another as shown in FIG. 20 to form a manually detachable union. When arranging the strap 68 as shown in FIGS. 19 and 20 the user is able to apply considerable force to the strap as it is positioned about the central region 16 of the housing 14. This in turn applies a constrictive force to the housing and the plugs therein. This constriction force is adapted to retain the plugs in their interengagement one with another and thereby assist in resisting the action of force being applied to the cords as identified by the arrows designated 106 and 107 in FIG. 4.

The width of the strap 68 may be varied. A wide width adapted to correspond generally to the width of the central region itself, may be used. In other embodiments, a strap width of smaller dimension may be used. Preferably, the strap 68 is fabricated of a material which is substantially nonstretchable along a direction parallel to its longitudinal axis.

As illustrated, the buckle 251 may be of a two-loop construction, whereby the user may alternatively pass the strap through the first loop 251A, and then through the second loop 251B and therefore loop the strap 68 back around the loop 251B and then reinsert the strap back through the first loop 251A.

Figure 21:
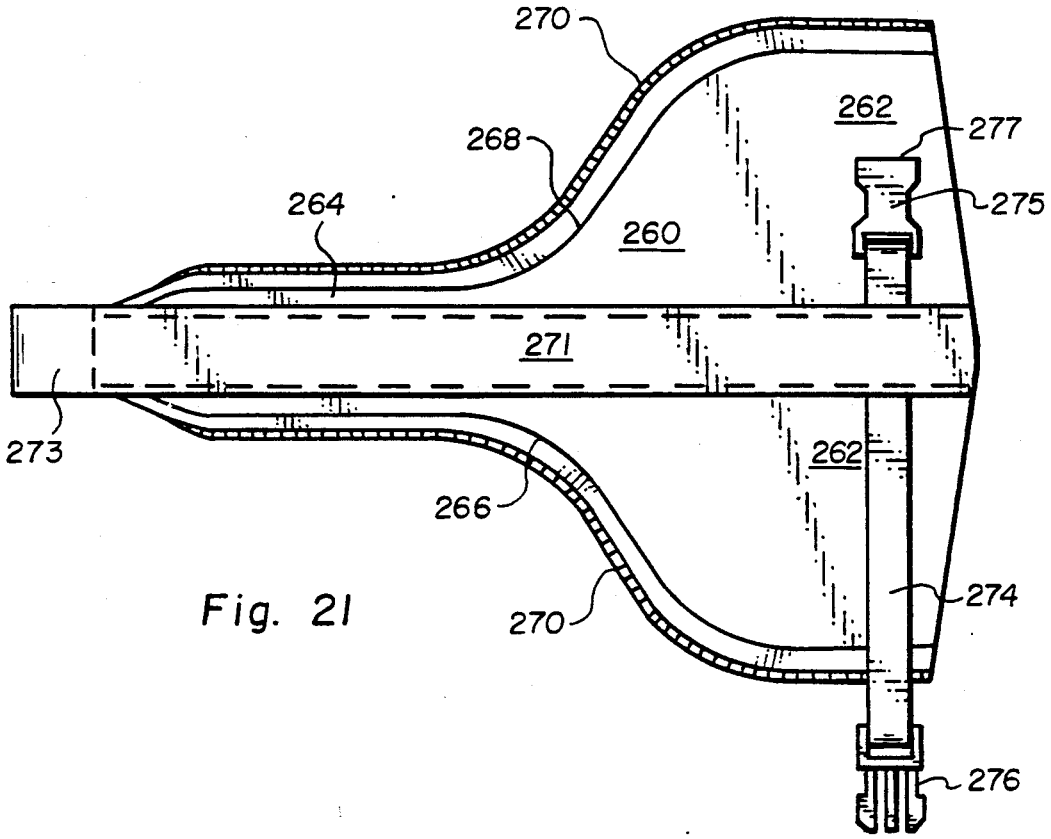
FIG. 21 is a plan view of another alternative embodiment of the invention.
Figure 22:
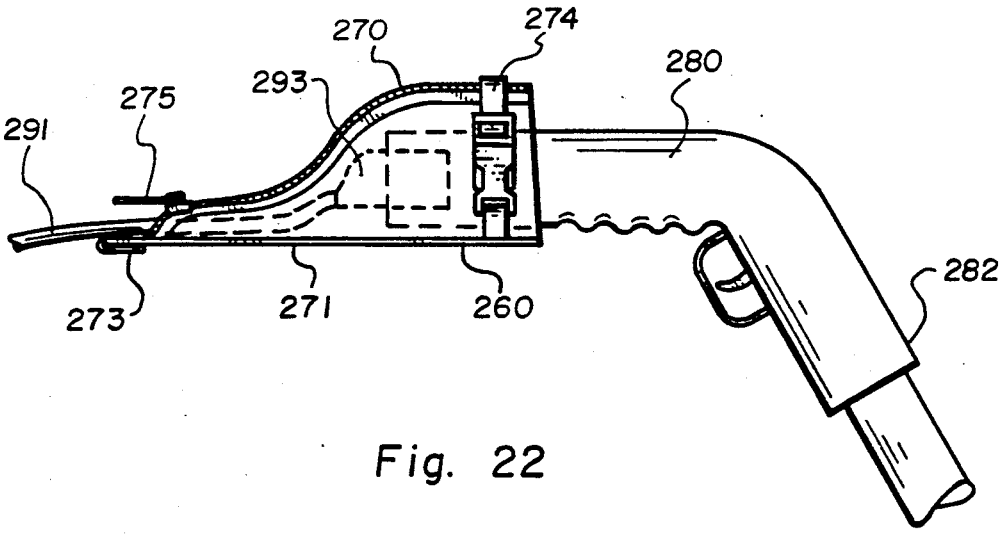
FIG. 22 is a side view of the embodiment of FIG. 21, shown installed on the handle of a piece of garden equipment.

FIGS. 21 and 22 illustrate an embodiment of the invention adapted for securing an electrical cord directly to the body of a piece of equipment such as, for example, garden equipment, e.g. weed trimmers or hedge trimmers. This embodiment is specifically directed to equipment which includes a rigid handle having two male electrical connection prongs secured therein to which an electrical cord may be intercooperated. This type of equipment conventionally does not include a cord with an electrical plug mounted therein.

The embodiment of FIGS. 21 and 22 includes a housing 260 having the configuration illustrated in FIG. 21, i.e. a section 262 dimensioned to be wrapped about a handle or other secure portion of the equipment and a longitudinally extending ear or section 264. The housing 280 is fabricated from the same material which forms the housing in the embodiment of FIG. 1. The housing defines a pair of opposing edges 266 and 268. A respective zipper track 270 is mounted to each of the edges 266 and 268. A reinforcement strip 271, fabricated and configured substantially identical to strip 34 of FIG. 1, is secured to housing 260 to extend along the longitudinal length of the housing. The strip 271 is doubled back on itself at its end to form a hand graspable tab 273. A zipper pull 275 is secured to the two zipper tracks 270 to constitute a means of engaging and disengaging the zipper tracks to or from one another. In this embodiment, as in all previously described embodiments, the zipper tracks are preferably fabricated from a material which is longitudinal non-stretchable. Furthermore, the reinforcement strip 271 is positioned substantially opposite from the zipper tracks when the retainer is in its installed condition. This placement of the reinforcement strip opposite from the zipper tracks is a characteristic common to all the embodiments of the instant invention and provides the retainer with an ability to resist longitudinal distortion.

A strap 274 is secured to the extension surface of the housing to encircle the circumference of the housing over the section 262 thereof. The strap 274 includes a free end 276 and a buckle 275 fitted end 277. The strap may be wrapped about the circumference of the housing when the housing is positioned over a handle 280 of a piece of equipment 282. The strap constricts the housing 260 about the handle 280 whereby the high coefficient inner surface of the housing is abutted against the handle to form a pressure union therewith.

The housing 260 is configured such that upon the two zipper tracks being engaged with one another, the housing is wrapped snugly about the cord 291, its plug 293 and the handle 280 to form a high coefficient of friction pressure fit union between those various members and the housing 280.

By contrast to some of the previously described embodiments wherein the retainer employs two laterally extending ears by which opposing cords are gripped and retained, the instant embodiment receives and retains a single cord. The instant embodiment is provided with a means of directly securing itself to the body of the equipment handle as a means of securing the electrical connection of the end with the male electrical prongs secured in the handle.

It is to be understood that the embodiments of the invention herein described are merely illustrative of the application of the principles of the invention. Reference herein to details of the illustrated embodiment is not intended to limit the scope of the claims which themselves recite those features regarded as essential to the invention.

What is claimed:

1. An electrical connection retainer comprising:

a housing having an elongate central region and laterally extending ears symmetrically arranged about said central region, said housing having a pair of spaced opposing edges;

an elongate reinforcement strip fabricated of a material which precludes a longitudinal stretching of said reinforcement strip, said reinforcement strip being secured to said housing elongate central region to extend longitudinally along said housing;

two zipper tracks, each said zipper track being secured to a respective edge of said housing;

a zipper pull mounted on said zipper tracks adapted for engaging and disengaging said zipper tracks;

wherein an engagement of said zipper tracks forms said housing into a tubular housing adapted to receive and retain a pair of intercooperated electrical connectors therein.

2. The electrical connector retainer of claim 1 wherein said housing is formed of at least two layers of material, a first layer defining an inner surface of said housing being formed of a material having a high coefficient of friction and a second layer, bonded to said first layer, being formed of a material which is longitudinally non-stretchable.

3. The electrical connection retainer of claim 2 wherein said first layer is formed of a rubber-like material.

4. The electrical connection retainer of claim 1, wherein a second zipper pull is mounted on said zipper tracks.

5. The electrical connection retainer of claim 1, wherein a strap having free ends is mounted on an exterior surface of said housing, said strap having interconnection means mounted thereon adapted for releasably interconnecting said free ends of said strap to form an endless loop for carrying a coiled electrical cord.

6. The electrical connection retainer of claim 5 wherein said strap is interposed between said housing and said reinforcement strip.

7. The electrical connection retainer of claim 5 wherein said strip is elongate and positioned orthogonal to said reinforcement strip.

8. The electrical connection retainer of claim 1, wherein said housing defines at least one end, said reinforcement strip being formed to define a hand graspable tab proximate said housing end.

9. The electrical connection retainer of claim 1 wherein a plurality of second reinforcement strips are mounted on said housing, said second reinforcement strips being mounted to extend radially from said reinforcement strip.

10. The electrical connection retainer of claim 1 wherein said housing is secured to an auxiliary housing adapted to be interconnected to an electrical wall outlet.

11. The electrical connection retainer of claim 10 wherein said auxiliary housing includes a fabric sheath and a rigid cover plate housed within said sheath.

12. The electrical connection retainer of claim 11 wherein said sheath includes a first panel and second panel, said first panel and said second panel being interconnected at their respective perimeters to form a sheath.

13. The electrical connection retainer of claim 10 wherein said housing is connected to said auxiliary housing by means of a plurality of fabric strips which are interconnected to said auxiliary housing on a first end thereof and are interconnected to said housing on a second end thereof.

14. The electrical connection retainer of claim 10 wherein a second housing is mounted on said auxiliary housing.

15. The electrical connection retainer of claim 14 wherein said second housing is oriented such that said reinforcement strips of said housings are positioned adjacent one another.

16. The electrical connection retainer of claim 10 wherein said zipper tracks are directly secured to said auxiliary housing.

17. The electrical connection retainer of claim 1 wherein a strap is mounted on said housing configured to be wrapped short about said elongate central region of said housing to circumscribe said elongate central region, said strap being adapted to constrict said elongate central region about said intercooperated electrical cords to retain said cords in their intercooperated condition.

18. The electrical connection retainer of claim 17 wherein said strap is fitted with a hook and loop fastener assembly adapted to permit said strap to be turned back on itself and form a union with itself.

19. An electrical connection retainer comprising:

a housing having a plug receiving region and a longitudinally extending ear, said housing having a pair of spacedly positioned opposing edges;

an elongate reinforcement strip fabricated of a material resistant to longitudinal stretching, said reinforcement strip being secured to said housing to extend along a longitudinal length thereof;

two zipper tracks, each zipper track being secured to a respective said edge of said housing; and a zipper pull mounted on said zipper tracks for engaging and disengaging said two zipper tracks;

wherein an engagement of said zipper tracks forms into a tubular housing adapted to be secured about a handle of a piece of equipment to retain an electrical plug in electrical connection with said handle.

* * * * *